US006298502B1

(12) United States Patent
Brown

(10) Patent No.: US 6,298,502 B1
(45) Date of Patent: Oct. 9, 2001

(54) MODULAR PORTABLE WASHSTAND

(75) Inventor: Henry F. Brown, Portage, WI (US)

(73) Assignee: Alltrista Corporation, Indianapolis, IN (US)

( * ) Notice: Subject to any disclaimer, the term of this patent is extended or adjusted under 35 U.S.C. 154(b) by 0 days.

(21) Appl. No.: 09/695,952

(22) Filed: Oct. 25, 2000

(51) Int. Cl.[7] ..... A47R 1/00

(52) U.S. Cl. ..... 4/626; 4/619; 4/640; 4/624

(58) Field of Search ..... 4/624, 625, 626, 4/627, 628, 629, 616, 619, 620, 639, 640, 650, 653, 539, 516, 517, 518, 519, 520, 262, 643, 646; D23/284

(56) References Cited

U.S. PATENT DOCUMENTS

| | | | | |
|---|---|---|---|---|
| D. 315,196 | | 3/1991 | Tegg et al. . | |
| D. 391,343 | | 2/1998 | Tagg . | |
| D. 401,679 | | 11/1998 | Tagg . | |
| 2,616,095 | | 11/1952 | Stuckey . | |
| 3,456,264 | | 7/1969 | Flagg . | |
| 3,594,830 | | 7/1971 | Clifton . | |
| 3,970,560 | * | 7/1976 | Metzger | 210/167 |
| 4,051,858 | * | 10/1977 | Mele | 134/56 R |
| 4,765,003 | | 8/1988 | Chang . | |
| 4,769,863 | | 9/1988 | Tegg et al. . | |
| 5,161,266 | | 11/1992 | Hildebrand . | |
| 5,182,822 | | 2/1993 | Cyr et al. . | |
| 5,213,119 | * | 5/1993 | Kusz et al. | 124/95.3 |
| 5,305,481 | | 4/1994 | Nebb . | |
| 5,470,477 | * | 11/1995 | Farnsworth | 210/634 |
| 5,687,434 | | 11/1997 | Tagg . | |
| 5,924,148 | | 7/1999 | Flowers, Sr. . | |

OTHER PUBLICATIONS

"The Wave™ Sink," Satellite Industries Inc., Minneapolis, MN www.satelliteindustries.com/acwave_na.html, Jan. 4, 2001.

"PJ III ™ Single User Wash Stand" PolyJohn Enteprises Corporation, Whiting, IN.

"Signature Series ™ & Fleet Series ™ Single User Sink", PolyJohn Enteprises Corporation, Whiting, IN.

* cited by examiner

*Primary Examiner*—Gregory L. Huson
*Assistant Examiner*—Huyen Le
(74) *Attorney, Agent, or Firm*—Lathrop & Clark LLP

(57) ABSTRACT

A central steel column serves as a core module for a portable washstand. The column extends upwardly from a horizontal foot, and has foot pumps which communicate with a water intake tube and with water spigots. In addition, the central column has fasteners, such as adjustable bands, for connecting fresh and waste water receptacles to the column. The receptacles may be conventional cylindrical drums, which support a molded plastic countertop with washbasins positioned beneath the spigots. For decorative purposes, a molded front panel extends between the countertop and the base, and together with a sheet rear panel encloses the two drums. Paper towel and soap dispensers may be connected to the central column.

24 Claims, 3 Drawing Sheets

MODULAR PORTABLE WASHSTAND

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to portable washstands in general, and to washstands which have an associated water supply and water collection housing in particular.

There are many circumstances where it is desirable or necessary to wash one's hands at a location which is far from running water. In the commercial world, construction sites, remote temporary facilities, farms, orchards, and agricultural facilities are all locations where the limited time of the employment or the variability of location may make permanent sanitary facilities impractical or uneconomical. In the provision of entertainment such as at sporting events, fairs, concerts, and special events, there also will be a need to provide facilities for washing hands, sometimes for many thousands of people, but only for a few days a year. In these circumstances the expense of constructing plumbed facilities is simply not justified. The solution widely adopted is the short term installation of portable toilets and washstands. These devices have fresh water and waste receptacles which are enclosed within the unit and do not connect to any outside water supply or sewerage system.

In order to produce a facility which is lightweight and durable, portable washstands have been fabricated of molded plastic. The plastic washstand can be molded in any desired shape, and hence can—with a few parts—provide multiple functions. Moreover, the plastic washstand is not susceptible to rust, requires no painting, and is waterproof. However, in order to extend the period of functionality of a stand-alone washstand it is necessary to provide significant volume for storage of fresh and waste water. Yet the manufacture of large plastic parts can be expensive, both in the design and manufacture of the molds, and in the actual fabrication of the finished parts. Some portable washstands have reduced the total volume required by combining in a single vessel freshwater and wastewater separated by a flexible membrane. Although this design approach is acceptable, it would be desirable to separate freshwater and wastewater as much as possible.

Moreover, different applications may require different washstand features. An industrial application may need to be rugged, but may not require ornamentation; a entertainment application may need to resist vandalism, yet have an attractive appearance. Maintaining a variety of different washstands in inventory can add to a distributor's costs.

What is needed is an economical portable washstand which limits the need to manufacture large specialized molded plastic parts, which is durable, and which is configurable to different needs.

SUMMARY OF THE INVENTION

The portable washstand of this invention has a core module or central column which contains the water pumps, spigots, and connecting conduits. The central column is rigid and durable, and has fasteners for releasibly attaching one or more water receptacles. The fasteners may be in the form of flexible bands or straps which form loops which encircle conventional plastic barrels or drums. The loops are clamped to restrain the barrels, allowing them to serve as the receptacles for the freshwater and the soiled or greywater. By fabricating parts which are readily assembled to conventional drums, the receptacle cost is minimized. This is particularly the case when expendable previously used drum shipping containers, of essentially no value, may be used. The central column extends upwardly from a platform which rests on a molded plastic base. In a two station washstand, the central column has two sets of flexible metal straps, an upper and a lower strap extending outwardly on each side of the column. Adjustable fasteners in the central column apply tension to the straps to retain the two drums in an upright orientation. The open tops of the drums are covered by a molded plastic countertop which has formed therein two washbasins. Each washbasin has a water spout and a foot operated pump. The pumps are associated with a water supply tube which extends into one of the drums which constitutes the freshwater receptacle. The wash stations are drained into the other drum which constitutes the waste water receptacle. The two spouts may be formed as integral parts of the stainless steel central column to resist vandalism. For decorative purposes, a molded front panel extends between the countertop and the base, and together with a sheet rear panel encloses the two drums. Paper towel and soap dispensers may be connected to the central column. For a single wash basin assembly, the same central column, although with only one spout, may be connected with a different countertop and base, with the single drum having a membrane dividing fresh water from waste water. In a similar fashion other assemblies may be constituted employing one or more common parts. For example, the decorative skirt may be omitted in industrial and agricultural applications.

It is an object of the present invention to provide a washstand which can be assembled from modular components about a central core module to permit economical modification of the washstand to suit different needs.

It is an additional object of the present invention to provide a low cost portable washstand which incorporates conventional plastic drums as water containers.

It is another object of the present invention to provide a washstand which is economically transported and may be assembled with locally available parts.

It is also an object of the present invention to provide a portable wash station which is readily modified in its appearance to suit different occasions.

It is a further object of the present invention to provide a sturdy portable washstand which is readily supplied with preloaded containers of water.

Further objects, features and advantages of the invention will be apparent from the following detailed description when taken in conjunction with the accompanying drawings.

DESCRIPTION OF THE PREFERRED EMBODIMENTS

Figure 1:
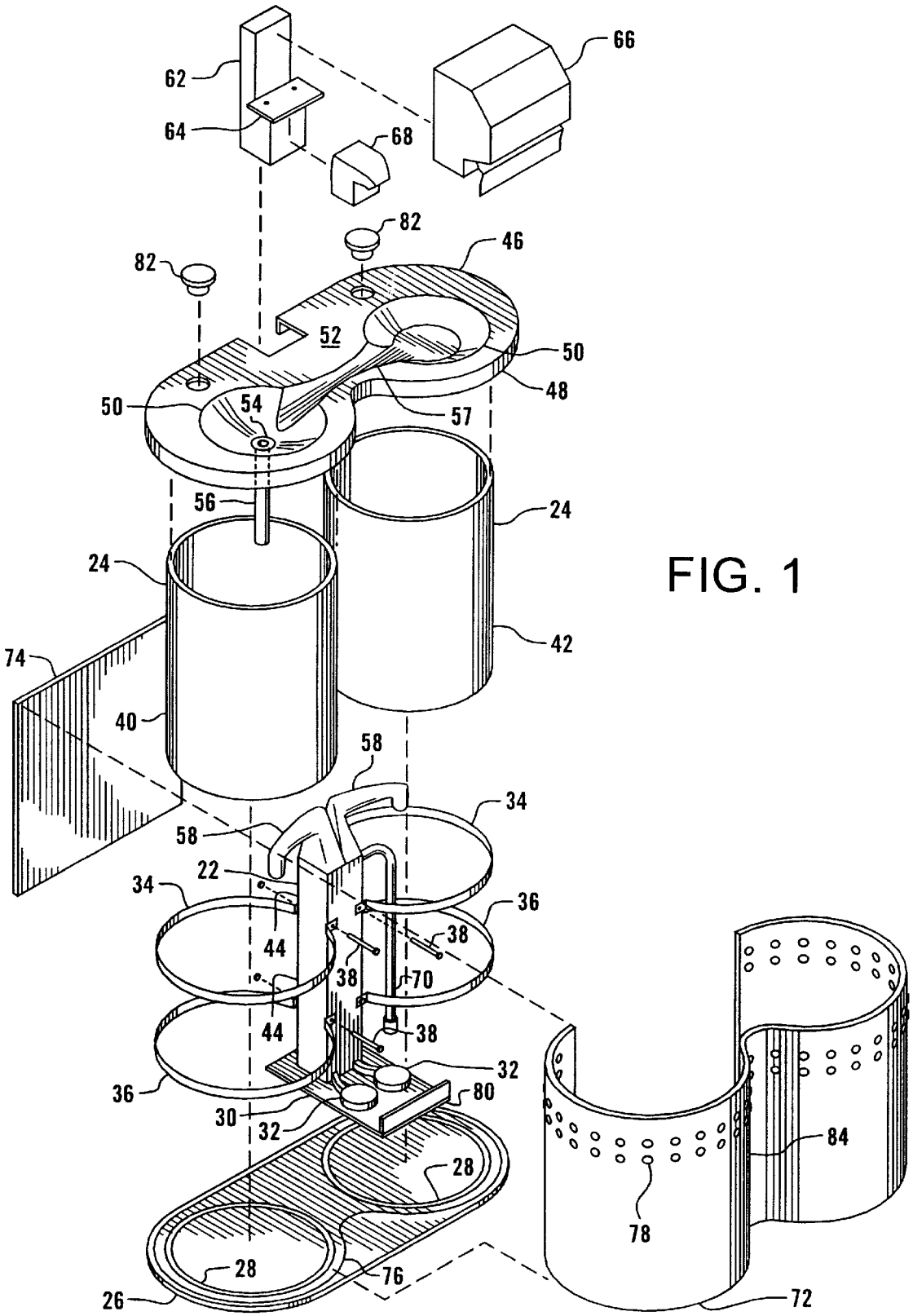
FIG. 1 is an exploded isometric view of the portable washstand of this invention.

Referring more particularly to the drawings, wherein like numbers refer to similar parts, a portable washstand 20 of this invention is shown in FIG. 1. The washstand 20 has a core module 86 with a central column 22, preferably formed of stainless steel, to which two drums 24 are clasped. The drums may be formed to a variety of configurations. In a particularly low cost example, conventional molded plastic cylindrical barrels or drums may be used. Another option would be to employ conventional trash receptacles. The column 22 and the drums 24 rest on a molded plastic base 26 which may have two circular rims 28 defining the outer perimeter of the drums. The column 22 has a rectangular foot 30 which extends outwardly and to which two foot operated pumps 32 are mounted. The foot 30 extends partially beneath the drums 24, thereby contributing to the stability of the upright column 22. The foot 30 preferably has an upwardly protruding flange or hook 80 which extends frontwardly of the drums 24. A tie-down strap, not shown, may then be used to restrain the washstand 20 against tipping when it is mounted within a truck, by applying the strap over the foot 30, and tightening it.

An upper band 34 and a lower band 36 for each drum extend on either side of the column 22 forming coaxial loops within which the drums 24 are received. The bands may be continuous through openings in the column, or, as shown, the bands may have right angle bent segments at each end which have holes which receive fasteners 38 therethrough. The fasteners 38 extend through holes 44 in the column 22. Tightening the fasteners 38 causes the bands to be clamped tightly around the drums 24 to hold them in place. One drum serves as a freshwater receptacle 40, while the other drum serves as the wastewater or gray water receptacle 42.

The bands 34, 36 permit readily available plastic drums to be used with the washstand 20 without requiring exact tolerances on the manufacture of the drums. Throughout the world, cylindrical drums of a diameter of about 23–24 inches are widely used for the transport of liquids and granular material. This type of drum is not a proprietary product and is manufactured by numerous manufacturers in very large quantities, typically by the process of blow molding. Blow molding is one of the most efficient means of making large hollow parts and is also a speedy process. The volume of these conventional plastic drums is approximately 55 gallons. The drums may be obtained with or without a top. Preferably for use within the washstand 20 drums without a top would be employed, or drums with tops would have the tops removed. Plastic drums are often used for transporting stock materials to end manufacturers, and hence are used by the manufacturer only to receive materials, not to ship finished product. For example a food processor might receive olives, syrups, or oils in plastic drums. Hence manufacturers of plastic drums are located throughout the world, making drums very easy to obtain. In addition, secondhand drums are also readily available. Because the washstand 20 may utilize conventional cylindrical drums it is economically manufactured—it some configurations eliminating the need to manufacture the largest components thereof; and it is also economically shipped overseas, because the largest volume components will be locally obtained. The bands 34, 36 may be flexible thin metal straps, or they may be braided fabric or fiberglass, or even a flexible rope, or some resilient material. This attachment arrangement allows drums of non-cylindrical or irregular shape to be readily accommodated. The upper and lower bands 34, 36 need not be of the same size, thus permitting the use of tapered drums. The mechanism illustrated for applying tension to the straps is illustrative, however other tensioning assemblies may be employed.

A molded plastic countertop 46 overlies the two drums 24 and has a downwardly extending skirt 48 which forms a barrier over the joint between the drums and the countertop. The countertop is preferably formed as a unitary molding which incorporates two oval washbasins 50. The countertop may be formed as a thermoformed thermoplastic part. The countertop 46 has a generally horizontal top wall 52 with the washbasins 50 being concave recesses extending below the top wall. Although each washbasin may be provided with an outlet and a drain which extends into the gray water receptacle 42, for simplified construction, the washbasin 50 over the gray water receptacle 42 has an outlet 54 at its lowest point which is connected to a drain 56. The wash water which enters the other washbasin 50 is conducted by a recessed trough 57 which extends from the lowest point of one washbasin into the other washbasin. Thus the washbasin which is connected to the drain 56 will be recessed to a greater extent than the other washbasin. The drain 56 extends into the gray water receptacle 42.

Two spouts 58 extend upwardly from the column 22 and are bent to face downwardly and to discharge water into a washbasin 50. The spouts 58 do not have valves or handles associated with them, because water can only be advanced through a spout 58 when a foot pump 32 is operated. The spouts 58 are thus connected to one of the foot pumps 32 by a conduit 88. The spouts 58 and the conduits 88 may be separate elements housed within the column or, alternatively, the spout may be integrally formed with the central column 22. The integral assembly has the advantage that the spouts are not removable from the column, and are thus extremely sturdy and resistant to impact. Such sturdiness tends to discourage acts of vandalism directed against the washstand 20.

A utilities support 62 extends above the countertop 46 and may be welded to the column 22 or otherwise attached to it. The utilities support 62 may have a bracket 64 to which a towel dispenser 66 is attached. The bracket 64 may extend horizontally as shown, or may extend vertically to permit the attachment of conventional towel dispensers which are configured for attachment to a vertical wall. A conventional soap dispenser 68 may be mounted to the utilities support 62 below the towel dispenser 66. Alternatively, the soap dispenser may be formed integrally with the column 22.

Water is supplied to the foot pumps 32 by a water intake tube 70 which extends from the column 22 at a level above the freshwater receptacle 40 and which descends into the freshwater receptacle drum to a level adjacent the bottom of the drum. The intake tube 70 is preferably a flexible plastic tube which will not interfere with the removal or installation of the receptacle 40. A perforated weight 94, as shown in FIG. 3, is preferably attached to the bottom of the water intake tube 70 to maintain the tube inlet at the lowest level within the fresh water receptacle, and to prevent the mouth of the tube becoming blocked by suction attachment to the bottom of a drum.

For cosmetic purposes, and to restrict access to the drums, the volume between the base 26 and the countertop 46 is enclosed by a molded front panel 72 and a rear panel 74. The front panel 72 and rear panel 74 may be received within a lip 76 protecting upwardly from the base 26. The front panel 72 is preferably molded in a single sheet thermoforming process and may have decorative indicia 78 molded therein. The decorative indicia 78 may be of a variety of decorations or patterns, allowing different front panels 72 to be attached to the washstand 20 for different occasions. For example, a pastel colored plastic front panel with floral decorations may be employed for use of the washstand at an outdoor wedding, while a gray or black undecorated front panel may be used when the washstand is placed at a construction site. The front panel may be molded in a splayed configuration to eliminate undercut portions in the mold, and then folded to assume the desired configuration. The rear panel which will typically not be visible may be formed of a rectangular extruded and cut sheet of plastic material. The rear panel 74 also may be received within the lip 76 on the base 26, and extends from the base to the countertop 46. The upper edges of the front panel 72 and rear panel 74 may be retained between the countertop skirt 48 and the drums 24.

The countertop may be provided with removable fittings 82 at the rear which permit the waste water to be drained from the grey water drum, and fresh water to be added to the freshwater drum. The fittings may have a simple lock mechanism, not shown, to restrict tampering with the drum contents.

Figure 3:
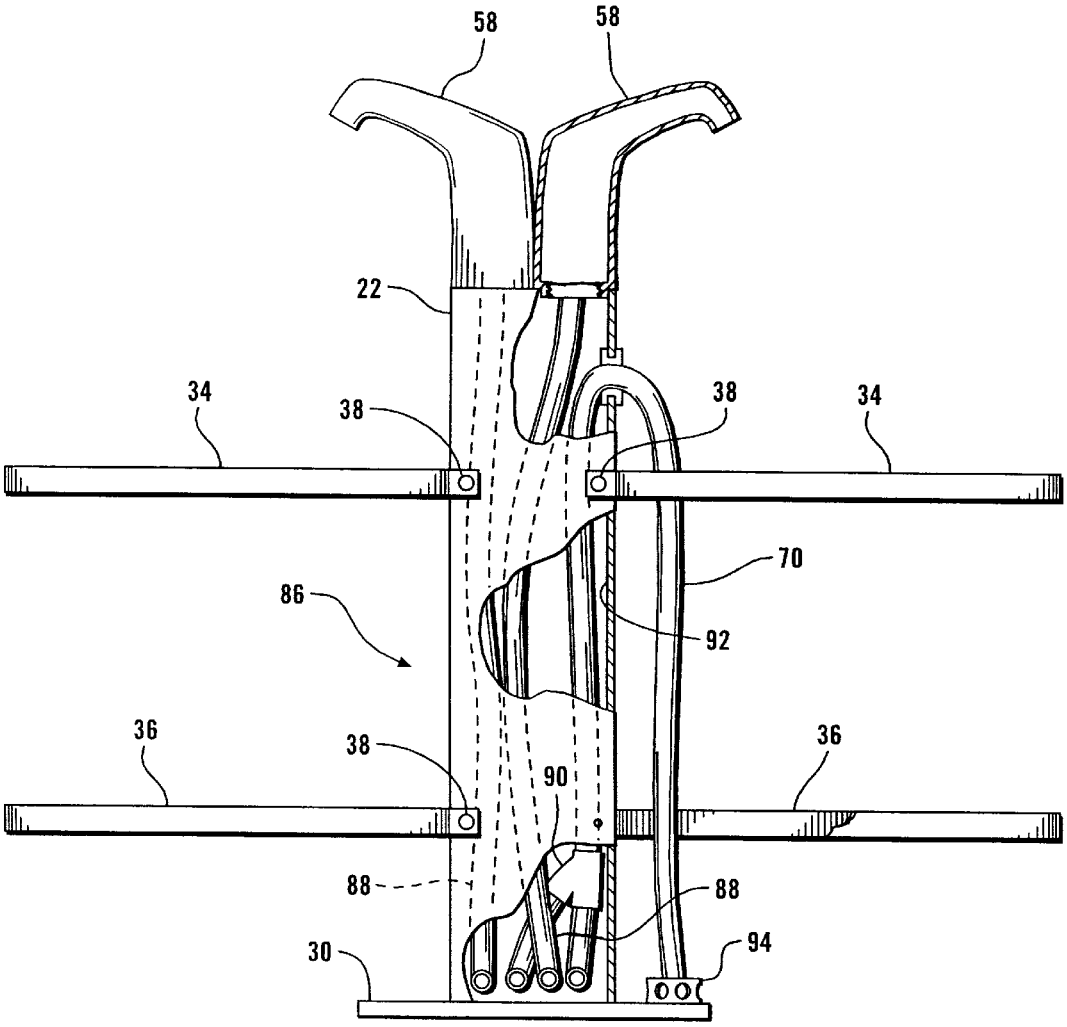
FIG. 3 is a front elevational view, partially broken away in section of the central column of the portable washstand of FIG. 1.

The washstand 20 is formed around a core module 86, which as shown in FIG. 3, includes the central column 22 and the essential plumbing elements of the washstand. Variable practical and ornamental accessories work in conjunction with the core module 86 to provide a washstand 20 for a particular application. In the core module 86, the central column 22 extends upwardly from the stabilizing foot 30 which supports both the column and the foot pumps 32. The central column 22 has an interior cavity which receives elements of the washstand plumbing. The core module 86 includes all the core mechanics and plumbing required to unite the receptacles 40, 42, with the washbasins 50. The conduits 88 between the foot pumps 32 and the spigots 58, the water intake tube 70 and the connections 90 between the intake tube and the foot pumps, and the fastening mechanism for attachment of the receptacles are all united with the central column 22 of the core module 86.

Although the central column 22 will usually not be the primary structural support for the countertop, it does have mechanical functions. First, it is sufficiently strong to hold the two receptacles together as they are moved. Second, the column 22 will need to have some torsional stiffness, as it will be subjected to impacts such as by collision or dropping which will tend to twist it. In the structure illustrated, the column is a single rectangular channel, with flexible nylon, rubber, or neoprene hoses 88, 90 which connect the pumps to the spigots, and the water intake tube 70 with the pumps. Alternatively, the column could be formed of three rectangular or cylindrical steel tubes welded together, with one serving as a conduit or store of soap, and one serving as a conduit between a foot pump and each spigot. In such an arrangement, several steel brackets are welded to the three conduit tubes to accept the flexible bands for securing the water receptacles.

Because the freshwater receptacle is a drum which is easily separated from the remainder of the washstand, the washstand 20 is readily supplied with fresh water in cases where potable water is not available at the final site, by shipping one or more drums prefilled with approved potable water, and sealing the drum with a removable seal. Many shipping devices such as forklift trucks are already configured for moving loaded drums of this type, so the filled plastic drums are readily moved from place to place with conventional equipment.

The washbasins are accessed by two persons standing in the recess 84 defined between the two adjacent drums, the washbasins being positioned along an axis which is about 30 degrees from the column 22. The front to back dimension of the washbasin is about 10 inches, and sufficient clearance is provided such that the user may stand at the washbasin, washing his hands and rinsing up to elbow height.

Figure 2:
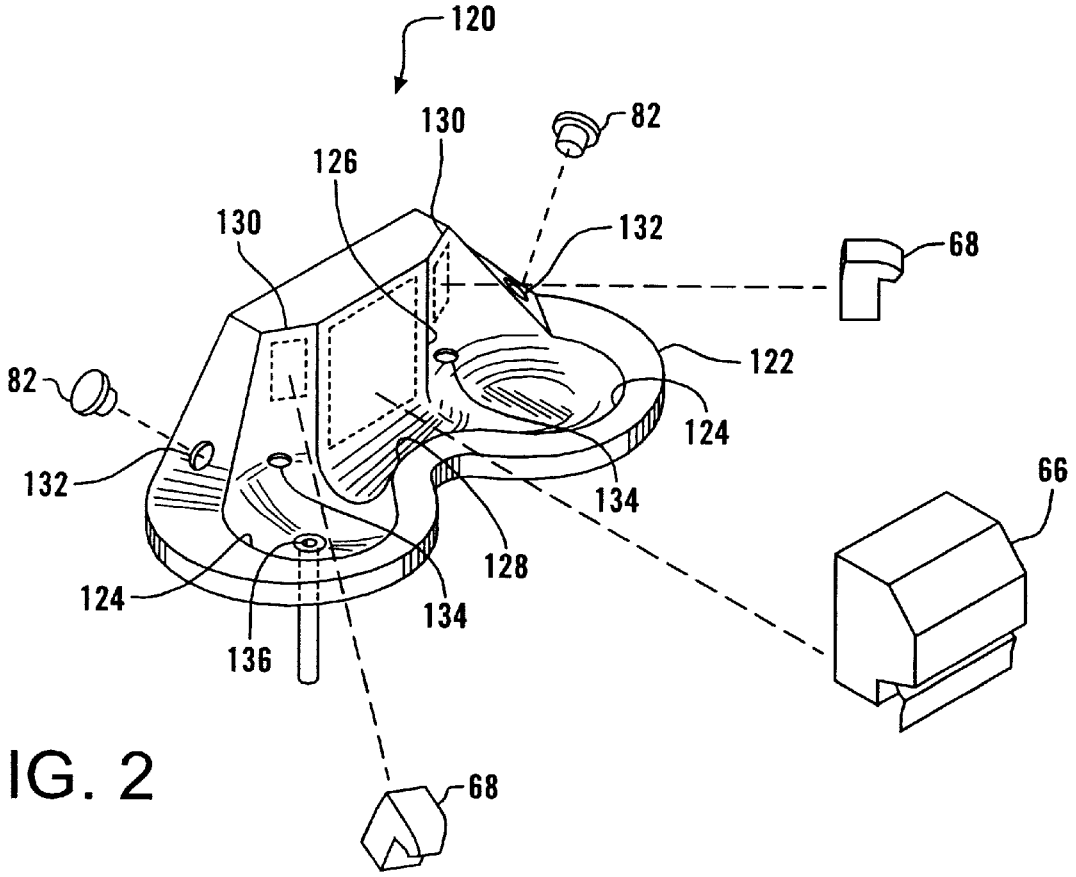
FIG. 2 is an exploded isometric view of an alternative embodiment countertop for the portable washstand of this invention.

An alternative embodiment washstand 120 may be provided with a countertop 122 which has two molded washbasins 124 and integral attachment surfaces for a paper towel dispenser 66 and two soap dispensers 68. As shown in FIG. 2, the countertop 122 has a frontwardly facing segment 126 extending above the connecting trough 128 between the washbasins 124. A paper towel dispenser 66 is attachable to the segment 126. Side segments 130 extend from the frontwardly facing segment 126 which extend above each washbasin. A soap dispenser 68 may be mounted by screws to each side segment 130. Alternatively, the frontwardly facing segment and the side segments may be configured to permit two paper towel dispensers to be positioned on either side of a single soap dispenser. Fittings 82 seal the entrances 132 to the drums provided adjacent each basin. The spouts will extend through the countertop 122 through openings 134 near each washbasin. As in the countertop discussed above, both washbasins drain through a single drain 136.

The washstand will typically be provided as a kit of parts for assembly by the end user into a washstand while using locally supplied drums. The design lends itself to modular assembly into different washstand configurations. For example, a single wash basin washstand, for use where space is at a premium, or where usage levels are lower, could be formed with a similar central column, but having only a single spout, and instead of two drums, having only a single drum with a collapsible membrane suspended within the drum to variably define a barrier between fresh water and waste water.

The central column, which is typically the most costly element of the washstand, can be configured with differing accessories to suit particular needs. For example, the decorative front panel 72 may not be attached for units being employed at purely industrial or agricultural sites, thus extending the life of the front panels for use in more consumer-oriented venues such as concerts and fairs. Likewise, the plastic base may be omitted in some situations.

Although cylindrical drums have been illustrated as receptacles for the fresh water and the gray water, it should be noted that rectangular, square, or irregular shaped drums may also be used. Or, alternatively, specially formed drums which have molded elements which snap onto portions of the central column, or onto portions of the opposing drum could also be used. Moreover, a custom drum may be molded with a square mounting flange which would be bolted directly to the central column. For further stiffness in the assembled washstand, the custom molded drum may have a downwardly opening straight channel which overlies a projecting flange formed on the column's metal foot 30.

It is understood that the invention is not limited to the particular construction and arrangement of parts herein illustrated and described, but embraces such modified forms thereof as come within the scope of the following claims.

I claim:

1. A portable washstand comprising:

a foot for engaging a support surface;

a central column which extends upwardly from the foot;

at least one water dispensing spout mounted to the central column;

a water intake tube extending from the central column;

a pump communicating with the water intake tube and the at least one water dispensing spout, such that operation of the pump draws from the water intake tube and supplies to said spout;

a fresh water receptacle positioned adjacent the central column, and positioned to receive the water intake tube within the fresh water receptacle;

a first fastener releasably engaging the fresh water receptacle and connecting it to the central column;

a waste water collecting receptacle positioned adjacent the central column;

a second fastener releasably engaging the waste water collecting receptacle and connecting it to the central column;

a counter top positioned over the fresh water receptacle and the waste water collecting receptacle and having portions defining at least one wash basin, wherein the at least one water dispensing spout is positioned to discharge water into the at least one wash basin;

a drain connected to the at least one wash basin, the drain communicating the waste water collecting receptacle to conduct water discharged into said basin into said waste water collecting receptacle.

2. The portable washstand of claim 1 wherein the foot extends sidewardly beneath the fresh water receptacle and the waste water collecting receptacle.

3. The portable washstand of claim 1 wherein the first and second fasteners comprise flexible straps connected to the central column to define loops within which the receptacles are received, the straps being capable of being tightened to encircle and clasp the receptacles to the central column.

4. The portable washstand of claim 1 wherein the fresh water receptacle and the waste water collecting receptacle are each conventional molded cylindrical drums.

5. The portable washstand of claim 1 further comprising:

a base underlying the foot;

a molded front panel extending from the base to the counter top; and a rear panel extending from the base to the counter top, wherein the front panel and the rear panel enclose the receptacles.

6. The portable washstand of claim 1 wherein the counter top has portions defining a plurality of wash basins, and wherein the wash basins are connected to one another such that the water received within all of the wash basins drains to a single wash basin, and from there is passed through the drain to the waste water collecting receptacle.

7. The portable washstand of claim 1 wherein a flange protrudes upwardly from the foot, the flange being positioned frontwardly of the column to receive a strap thereover.

8. The portable washstand of claim 1 wherein the countertop has portions defining two wash basins, and a frontwardly facing segment extending above the washbasins, and two side segments, one extending on either side of the frontwardly facing segment, and wherein at least one paper towel dispenser and one soap dispenser are attached to the frontwardly facing segment and at least one of the side segments.

9. The portable washstand of claim 1 further comprising:

a molded plastic base beneath the foot; and a front panel which extends from the base to the countertop.

10. A portable washstand comprising:

an upwardly extending central column;

at least one water dispensing spout mounted to the central column;

a water intake tube extending from the central column;

a first flexible strap formed into a loop and connected to a first side of the central column;

a first receptacle positioned adjacent the first side of the central column within the first flexible strap loop;

a first fastener fixed to the central column and cooperating with the first flexible strap to permit the first receptacle to be clasped within the loop;

a second receptacle connected to the central column, wherein one of the first receptacle and the second receptacle is positioned to receive the water intake tube and serves as the fresh water receptacle, and the other receptacle serves as a waste water receptacle;

a pump communicating with the water intake tube and the at least one water dispensing spout, such that operation of the pump draws from the water intake tube and supplies to said spout;

a counter top positioned over the fresh water receptacle and the waste water collecting receptacle and having portions defining at least one wash basin, wherein the at least one water dispensing spout is positioned to discharge water into the at least one wash basin; and a drain connected to the at least one wash basin, the drain communicating with the waste water collecting receptacle to conduct water discharged into said basin into said waste water collecting receptacle.

11. The portable washstand of claim 10 further comprising:

a molded plastic base beneath the column; and a front panel which extends from the base to the countertop.

12. The portable washstand of claim 11 wherein a rim extends upwardly from the base to retain the front panel, and wherein the front panel is molded to have protruding indicia therein.

13. The portable washstand of claim 10 further comprising:

a second flexible strap formed into a second loop and connected to the first side of the central column; and a second fastener fixed to the central column and cooperating with the second flexible strap to permit the first receptacle to be clasped within the second loop.

14. The portable washstand of claim 10 wherein a foot extends sidewardly from the central column beneath the fresh water receptacle and the waste water collecting receptacle.

15. The portable washstand of claim 10 wherein a flange protrudes upwardly from the foot, the flange being positioned frontwardly of the column to receive a strap thereover.

16. The portable washstand of claim 10 wherein the countertop has portions defining two wash basins, and a frontwardly facing segment extending above the washbasins, and two side segments, one extending on either side of the frontwardly facing segment, and wherein at least one paper towel dispenser and one soap dispenser are attached to the frontwardly facing segment and at least one of the side segments.

17. The portable washstand of claim 10 further comprising:

a base underlying the central column;

a molded front panel extending from the base to the countertop; and a rear panel extending from the base to the counter top, wherein the front panel and the rear panel enclose the first and second receptacles.

18. The portable washstand of claim 10 wherein the countertop has portions defining a plurality of wash basins, and wherein the wash basins are connected to one another such that the water received within all of the wash basins drains to a single wash basin, and from there is passed through the drain to the waste water collecting receptacle.

19. The portable washstand of claim 10 wherein the fresh water receptacle and the waste water collecting receptacle are each conventional molded cylindrical drums spaced on opposite sides of the central column.

20. A core module for assembly with a fresh water receptacle and a gray water receptacle, to form a washstand, the core module comprising:

a rigid central column extending upwardly from a foot, the central column defining an interior cavity;

a first foot pump mounted to the foot;

a water intake tube extending from the central column at a position above the foot pump and communicating with the foot pump, the water intake tube extending exterior to the central column to be received within a fresh water receptacle;

a spigot fixed to the central column above the foot pump;

a conduit extending within the central column interior cavity between the first foot pump and the spigot, for conducting water drawn in through the water intake tube and advanced by the foot pump to the spigot;

a fastener assembly extending sidewardly from the central column to engage a receptacle exterior to the column and to connect said receptacle to the central column.

21. The washstand core module of claim 20 wherein the fastener assembly comprises a flexible strap connected to the central column to define a loop within which a receptacle is receivable, and a fastener mounted to the column to engage against the strap causing it to tighten about a receptacle and clasp it to the central column.

22. The washstand core module of claim 20 wherein a flange protrudes upwardly from the foot, the flange being positioned frontwardly of the column to receive a strap thereover.

23. The washstand core module of claim 20 wherein two spigots extend from the central column, and further comprising a second fastener assembly to engage two receptacles to the central column.

24. An apparatus for assembly with two barrels to form a washstand, the assembly comprising:

a base;

a central column which extends upwardly from the base;

two water dispensing spouts mounted to the central column;

a first flexible strap formed into a loop and connected to a first side of the central column;

a first fastener fixed to the central column and cooperating with the first flexible strap to permit a first cylindrical barrel to be engaged within the loop of the first flexible strap, the first barrel defining a water supply receptacle;

a second flexible strap formed into a loop and connected to a second side of the central column, opposite the first side;

a second fastener fixed to the central column and cooperating with he second flexible strap to permit a second cylindrical barrel to be engaged within the loop of the second flexible strap, the second barrel defining a waste water receptacle;

a first cylindrical drum which is positioned on the base adjacent the central column, wherein the first flexible strap extends around the drum and secures the first cylindrical drum to the central column;

a water intake tube positioned to draw water from the first cylindrical drum;

a pump communicating with the water supply tube and the spouts, such that activation of the pump moves water from the first cylindrical drum to the spouts;

a countertop spaced above the base and above the flexible straps, the countertop having portions defining two wash basins, wherein the water dispensing spouts are positioned to discharge water into the wash basins; and a drain communicating with the second drum to discharge water from the basins into the second drum.

* * * * *